US009593849B2

(12) United States Patent
Geraets

(10) Patent No.: US 9,593,849 B2
(45) **Date of Patent: *Mar. 14, 2017**

(54) COMBUSTION OF HIGH SOLIDS LIQUID

(71) Applicant: POET Research, Inc., Sioux Falls, SD (US)

(72) Inventor: James M. Geraets, Sioux Falls, SD (US)

(73) Assignee: POET Research, Inc., Sioux Falls, SD (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/958,129

(22) Filed: Dec. 3, 2015

(65) Prior Publication Data

US 2016/0084498 A1 Mar. 24, 2016

Related U.S. Application Data

(63) Continuation of application No. 12/875,623, filed on Sep. 3, 2010, now Pat. No. 9,353,944.

(60) Provisional application No. 61/239,693, filed on Sep. 3, 2009.

(51) Int. Cl.

| | |
|---|---|
| ***F23G 7/04*** | (2006.01) |
| ***F23G 5/30*** | (2006.01) |
| ***F23G 5/00*** | (2006.01) |
| ***F23G 5/44*** | (2006.01) |
| ***F23G 5/02*** | (2006.01) |
| ***F23G 5/50*** | (2006.01) |
| ***F23J 3/00*** | (2006.01) |

(Continued)

(52) U.S. Cl.

CPC ..... *F23G 5/30* (2013.01); *F23G 5/006* (2013.01); *F23G 5/008* (2013.01); *F23G 5/02* (2013.01); *F23G 5/446* (2013.01); *F23G 5/50* (2013.01); *F23G 7/04* (2013.01); *F23J 3/00* (2013.01); *F23B 7/00* (2013.01); *F23G 5/04* (2013.01); *F23G 2201/10* (2013.01); *F23G 2900/50208* (2013.01)

(58) Field of Classification Search

CPC ..... F23G 5/30; F23G 5/04; F23J 3/00; F23B 7/00

USPC ..... 431/2, 11, 161, 174, 190; 110/348, 216, 110/224, 243

See application file for complete search history.

(56) References Cited

U.S. PATENT DOCUMENTS

| | | | |
|---|---|---|---|
| 3,117,537 | A | 1/1964 | Mitchell et al. |
| 3,309,262 | A | 3/1967 | Copeland et al. |
| 4,305,790 | A | 12/1981 | Kramer |

(Continued)

OTHER PUBLICATIONS

Non-Final Office Action for U.S. Appl. No. 12/875,623 dated Aug. 6, 2013, 29 pages.

(Continued)

*Primary Examiner* — Gregory Huson
*Assistant Examiner* — Nikhil Mashruwala
(74) *Attorney, Agent, or Firm* — Amin, Turocy & Watson, LLP

(57) ABSTRACT

A system for the combustion of high solids liquid to produce steam for the production of ethanol is disclosed. The system comprises a method for combusting high solids liquid. The method comprises supplying a stream of high solids liquid to a furnace; atomizing the stream of high solids liquid into the furnace; and distributing biomass fuel into the furnace. The stream of high solids liquid are combusted with the biomass fuel in the furnace.

26 Claims, 19 Drawing Sheets

(51) Int. Cl.
*F23B 30/00* (2006.01)
*F23G 5/04* (2006.01)

(56) References Cited

U.S. PATENT DOCUMENTS

| | | | | |
|---|---|---|---|---|
| 4,669,399 | A | 6/1987 | Martin et al. | |
| 5,044,288 | A | 9/1991 | Barlow | |
| 5,307,746 | A | 5/1994 | Khinkis et al. | |
| 5,609,113 | A | 3/1997 | Galipeault et al. | |
| 6,357,367 | B1 | 3/2002 | Breen et al. | |
| 6,390,076 | B2 | 5/2002 | Hunt | |
| 6,497,187 | B2 | 12/2002 | Khinkis et al. | |
| 6,655,304 | B1 | 12/2003 | Barlow | |
| 6,694,900 | B2 | 2/2004 | Lissianski et al. | |
| 7,263,934 | B2 | 9/2007 | Copeland et al. | |
| 7,806,090 | B2 | 10/2010 | McBurney et al. | |
| 7,832,344 | B2 | 11/2010 | Capote et al. | |
| 7,975,628 | B2 | 7/2011 | Martin et al. | |
| 8,544,394 | B2 * | 10/2013 | Hunsinger | F23G 5/14 110/248 |
| 2002/0007772 | A1 | 1/2002 | Janssen et al. | |
| 2003/0019736 | A1 | 1/2003 | Garman | |
| 2004/0255831 | A1 | 12/2004 | Rabovitser et al. | |
| 2007/0266916 | A1 | 11/2007 | Copeland et al. | |
| 2009/0239185 | A1 | 9/2009 | Deline et al. | |
| 2009/0285935 | A1 | 11/2009 | Brophy et al. | |

OTHER PUBLICATIONS

Final Office Action for U.S. Appl. No. 12/875,623 dated Jan. 17, 2014, 28 pages.
Non-Final Office Action for U.S. Appl. No. 12/875,623 dated May 8, 2015, 13 pages.

* cited by examiner

OPERATING CONDITION

OPERATING CONDITION

OPERATING CONDITION

CO & NOx (ppm) vs syrup operational conditions with no urea data chart

FIG. 17

Combustion Analysis of Syrup

| | As Received | Dry | Air Dry |
|---|---|---|---|
| Proximate (%) | | | |
| Moisture | 60.25 | 0.00 | 1.02 |
| Ash | 3.24 | 8.14 | 8.06 |
| Volatile | 32.99 | 82.99 | 82.14 |
| Fixed C | 3.52 | 8.87 | 8.78 |
| Total | 100.00 | 100.00 | 100.00 |
| Sulfur | 0.67 | 1.68 | 1.66 |
| Btu/lb (HHV) | 3648 | 9176 | 9083 |
| MMF Btu/lb | 3759 | 10071 | |
| MAF Btu/lb | | 9990 | |
| Air Dry Loss (%) | 59.84 | | |

FIG. 18

Combustion Analysis of C6 Solids

| | As Received | Dry | Air Dry |
|---|---|---|---|
| Proximate (%) | | | |
| Moisture | 71.20 | 0.00 | 2.06 |
| Ash | 4.24 | 14.72 | 14.42 |
| Volatile | 18.20 | 63.19 | 61.89 |
| Fixed C | 6.36 | 22.09 | 21.63 |
| Total | 100.00 | 100.00 | 100.00 |
| Sulfur | 0.050 | 0.175 | 0.171 |
| Btu/lb (HHV) | 2551 | 8856 | 8674 |
| MMF Btu/lb | 2672 | 10533 | |
| MAF Btu/lb | | 10385 | |
| Air Dry Loss (%) | 70.59 | | |

FIG. 19

CO & NOx (ppm) vs syrup operational conditions

| with syrup > 5and <10gpm | | with syrup > 10and<15gpm | | with syrup > 15gpm | | without syrup | |
|---|---|---|---|---|---|---|---|
| CO | NOx | CO | NOx | CO | NOx | CO | NOx |
| 119.57 | 40.89 | 68.30 | 41.71 | 98.52 | 40.13 | 57.95 | 38.14 |

FIG. 20

CO & NOx (ppm) vs syrup operational conditions with no urea

| with syrup > 5and <10gpm | | with syrup > 10and<15gpm | | with syrup > 15gpm | | with syrup > 5 | | without syrup | |
|---|---|---|---|---|---|---|---|---|---|
| CO | NOx | CO | NOx | CO | NOx | CO | NOx | CO | NOx |
| 5.83 | 57.43 | 17.41 | 59.07 | 10.75 | 53.19 | 16.58 | 58.40 | 4.97 | 77.45 |

FIG. 21

CO emissions (ppm) vs operational conditions

| | no water or syrup flow | water flow only | syrup flow only - before cleaning | syrup flow only - post cleaning |
|---|---|---|---|---|
| CO (ppm) | 412.29 | 1901.14 | 49.47 | 73.59 |
| Flow (gpm) | 0.20 | 12.41 | 11.69 | 7.34 |

COMBUSTION OF HIGH SOLIDS LIQUID

CROSS REFERENCE TO RELATED APPLICATIONS

The present application is a Continuation of application Ser. No. 12/875,623 filed Sep. 3, 2010, which claims priority to U.S. Provisional Application Ser. No. 61/239,693, titled "SYSTEM FOR COMBUSTING CONDENSED SOLUBLES", filed on Sep. 3, 2009, both of which are hereby incorporated by reference.

FIELD

The present invention relates to combustion of high solids liquid. The present invention also relates to combustion of high solids liquid produced during the production of ethanol.

BACKGROUND

Ethanol can be produced from grain-based feedstocks (e.g. corn, sorghum/milo, barley, wheat, soybeans, etc.), from sugar (e.g. from sugar cane, sugar beets, etc.), and from biomass (e.g. from lignocellulosic feedstocks such as switchgrass, corn cobs and stover, wood or other plant material).

Biomass comprises plant matter that can be suitable for direct use as a fuel/energy source or as a feedstock for processing into another bioproduct (e.g., a biofuel such as cellulosic ethanol) produced at a biorefinery (such as an ethanol plant). Biomass may comprise, for example, corn cobs and stover (e.g., stalks and leaves) made available during or after harvesting of the corn kernels, fiber from the corn kernel, switchgrass, farm or agricultural residue, wood chips or other wood waste, and other plant matter (grown for processing into bioproducts or for other purposes). In order to be used or processed, biomass will be harvested and collected from the field and transported to the location where it is to be used or processed.

In a conventional ethanol plant producing ethanol from corn, ethanol is produced from starch. Corn kernels are cleaned and milled to prepare starch-containing material for processing. (Corn kernels can also be fractionated to separate the starch-containing material (e.g. endosperm) from other matter (such as fiber and germ).) The starch-containing material is slurried with water and liquefied to facilitate saccharification where the starch is converted into sugar (e.g. glucose) and fermentation where the sugar is converted by an ethanologen (e.g. yeast) into ethanol. The product of fermentation (e.g. fermentation product) is beer, which comprises a liquid component containing ethanol and water and soluble components, and a solids component containing unfermented particulate matter (among other things). The fermentation product is sent to a distillation system. In the distillation system, the fermentation product is distilled and dehydrated into ethanol. The residual matter (e.g. whole stillage) comprises water, soluble components, oil and unfermented solids (e.g. the solids component of the beer with substantially all ethanol removed that can be dried into dried distillers grains (DDG) and sold as an animal feed product). Water removed from the fermentation product in distillation and evaporation can be re-used at the plant. The soluble components, for example syrup (and oil contained in the syrup), can also be recovered from the stillage. Whole stillage and syrup are examples of high solids liquid.

In a biorefinery configured to produce ethanol from biomass, ethanol is produced from lignocellulosic material.

Lignocellulosic biomass typically comprises cellulose, hemicellulose and lignin. Cellulose (a type of glucan) is a polysaccharide comprising hexose (C6) sugar monomers such as glucose linked in linear chains. Hemicellulose is a branched chain polysaccharide that may comprise several different pentose (C5) sugar monomers (such as xylose and arabinose) and small amounts of hexose (C6) sugar monomers (such as mannose, galactose, rhamnose and glucose) in branched chains.

The biomass is prepared so that sugars in the lignocellulosic material (such as glucose from the cellulose and xylose from the hemicellulose) can be made accessible and fermented into a fermentation product from which ethanol can be recovered. After fermentation, the fermentation product is sent to the distillation system, where the ethanol is recovered by distillation and dehydration. Other bioproducts such as lignin and organic acids may also be recovered as byproducts or co-products during the processing of biomass into ethanol. Determination of how to more efficiently prepare and treat the biomass for production into ethanol will depend upon the source and type or composition of the biomass. Biomass of different types or from different sources is likely to vary in properties and composition (e.g. relative amounts of cellulose, hemicellulose, lignin and other components). For example, the composition of wood chips will differ from the composition of corn cobs or switchgrass.

It would be advantageous to provide for a system for combusting high solids liquid.

SUMMARY

The present invention relates to a system that employs a method for combusting high solids liquid. The method comprises supplying a stream of high solids liquid to a furnace; atomizing the stream of high solids liquid into the furnace; and distributing biomass fuel into the furnace. The stream of high solids liquid is co-combusted with the biomass fuel in the furnace.

The present invention also relates to biorefinery for the production of ethanol, the biorefinery comprising: a pre-treatment system that pre-treats lignocellulosic biomass into pre-treated biomass; a fermentation system that ferments the pre-treated biomass into fermented beer; a distillation system that distills fermented beer into whole stillage; a separation system that separates the whole stillage into wet solids and thin stillage; an evaporation system that evaporates the thin stillage into syrup; and a combustion system that atomizes the syrup into a furnace, wherein the syrup is combusted in suspension above biomass fuel in the furnace.

DESCRIPTION OF THE DRAWINGS

FIG. 17 shows a combustion analysis of syrup.

FIG. 18 shows a combustion analysis of C6 solids.

FIGS. 19, 20 and 21 show data and results obtained through the use of a combustion system according to exemplary embodiments.

DESCRIPTION OF THE EMBODIMENTS

Figure 1A:
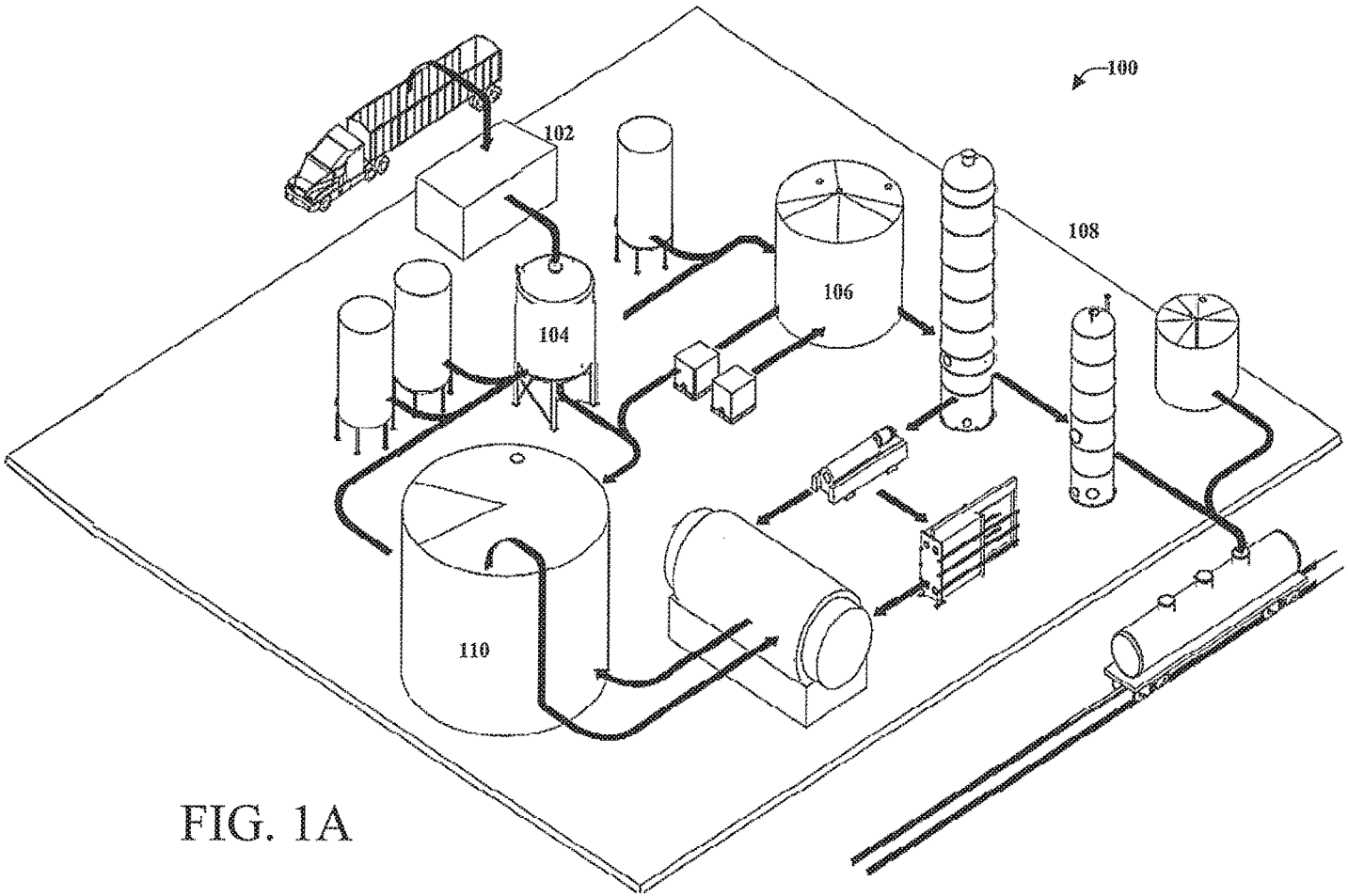
FIG. 1A is a perspective view of a biorefinery comprising a cellulosic ethanol production facility.

Referring to FIG. 1A, a biorefinery 100 configured to produce ethanol from biomass is shown.

According to an exemplary embodiment, the biorefinery 100 is configured to produce ethanol from biomass in the form of a lignocellulosic feedstock such as plant material from the corn plant (e.g. corn cobs and corn stover). Lignocellulosic feedstock such as lignocellulosic material from the corn plant comprises cellulose (from which C6 sugars such as glucose can be made available) and/or hemicellulose (from which C5 sugars such as xylose and arabinose can be made available).

As shown in FIG. 1A, the biorefinery comprises an area where biomass is delivered and prepared to be supplied to the cellulosic ethanol production facility. The cellulosic ethanol production facility comprises apparatus for preparation 102, pre-treatment 104 and treatment of the biomass into treated biomass suitable for fermentation into fermentation product in a fermentation system 106. The facility comprises a distillation system 108 in which the fermentation product is distilled and dehydrated into ethanol. As shown in FIG. 1A, the biorefinery may also comprise a waste treatment system 110 (shown as comprising an anaerobic digester). According to other alternative embodiments, the waste treatment system may comprise other equipment configured to treat, process and recover components from the cellulosic ethanol production process, such as a solid/waste fuel boiler (with a system to combust high solids liquids), anaerobic digester, aerobic digester or other biochemical or chemical reactors.

Figure 1B:
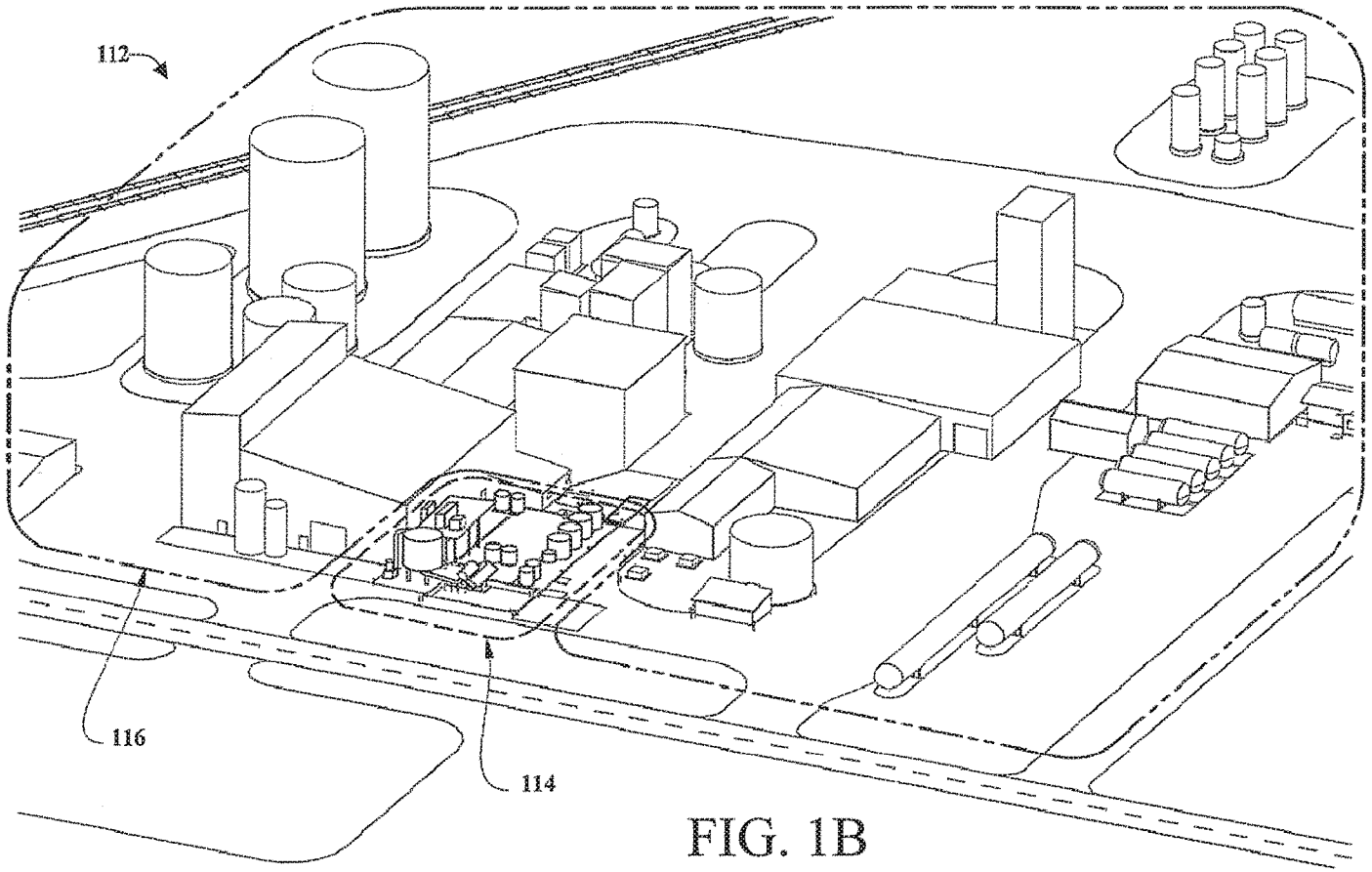
FIG. 1B is a perspective view of a biorefinery comprising a cellulosic ethanol production facility and a corn-based ethanol production facility.

As shown in FIG. 1B, according to an exemplary embodiment, a biorefinery 112 may comprise a cellulosic ethanol production facility 114 (which produces ethanol from lignocellulosic material and components of the corn plant) co-located with a corn-based ethanol production facility 116 (which produces ethanol from starch contained in the endosperm component of the corn kernel). As indicated in FIG. 1B, by co-locating the two ethanol production facilities, certain plant systems may be shared. Fuel or energy sources such as methane or lignin from the cellulosic ethanol production facility may be used to supply power to either or both co-located facilities. According to other alternative embodiments, a biorefinery (e.g. a cellulosic ethanol production facility) may be co-located with other types of plants and facilities, for example an electric power plant, a waste treatment facility, a lumber mill, a paper plant or a facility that processes agricultural products.

Figure 2:
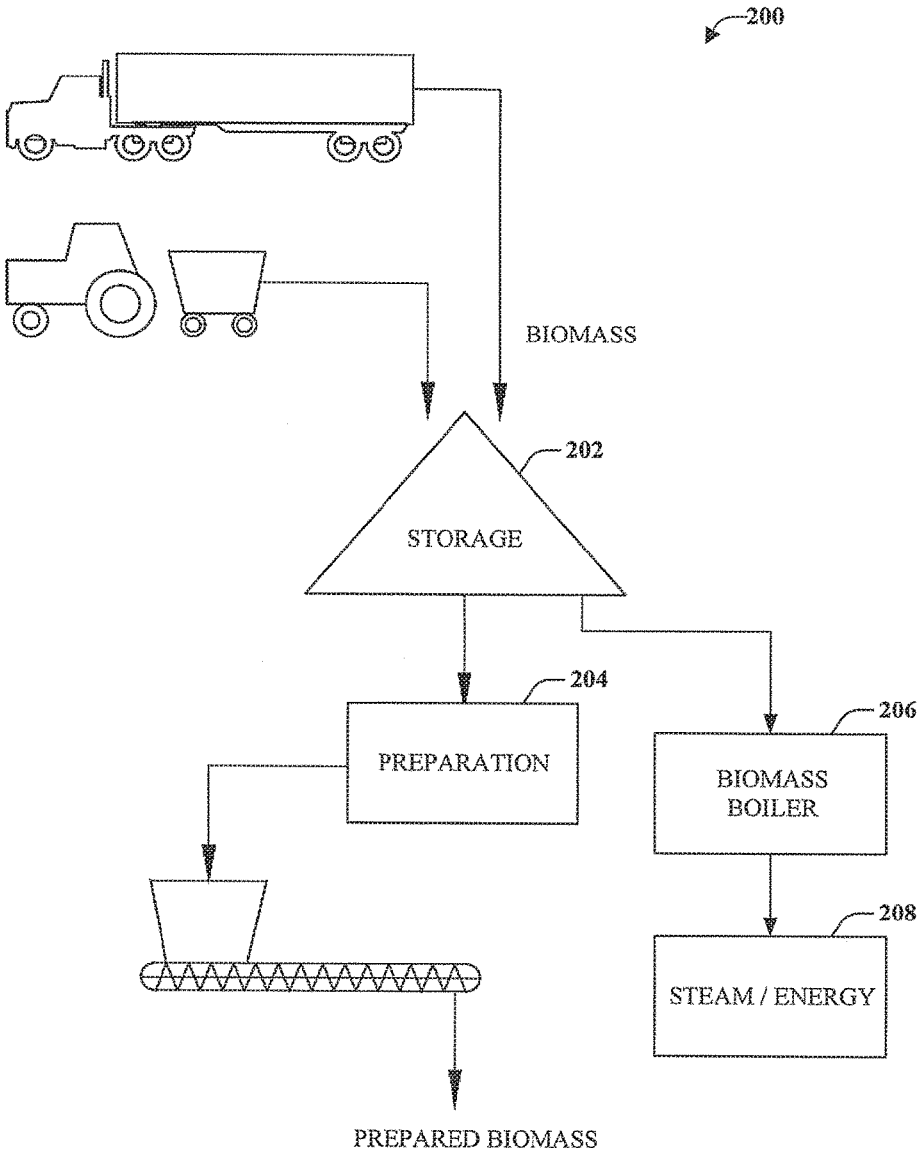
FIG. 2 is a schematic diagram of a system for receipt and preparation of biomass for a cellulosic ethanol production facility.

Referring to FIG. 2, a system 200 for preparation of biomass delivered to the biorefinery is shown. The biomass preparation system may comprise apparatus for receipt/unloading of the biomass, cleaning (e.g. removal of foreign matter), grinding (e.g. milling, reduction or densification), and transport and conveyance for processing at the plant. According to an exemplary embodiment, biomass in the form of corn cobs and stover may be delivered to the biorefinery and stored (e.g. in bales, piles or bins, etc.), shown as storage 202, and managed for use at the facility. According to a preferred embodiment, the biomass may comprise at least 20 to 30 percent corn cobs (by weight) with corn stover and other matter. According to other exemplary embodiments, the preparation system 204 of the biorefinery may be configured to prepare any of a wide variety of types of biomass (e.g. plant material) for treatment and processing into ethanol and other bioproducts at the plant. The preparation system 204 can also produce high solids liquid, such as whole stillage or syrup. The high solids liquid can be combusted in a biomass boiler 206 with biomass fuel (e.g., from storage 202) to produce steam and/or energy 208 for the biorefinery.

Figure 3:
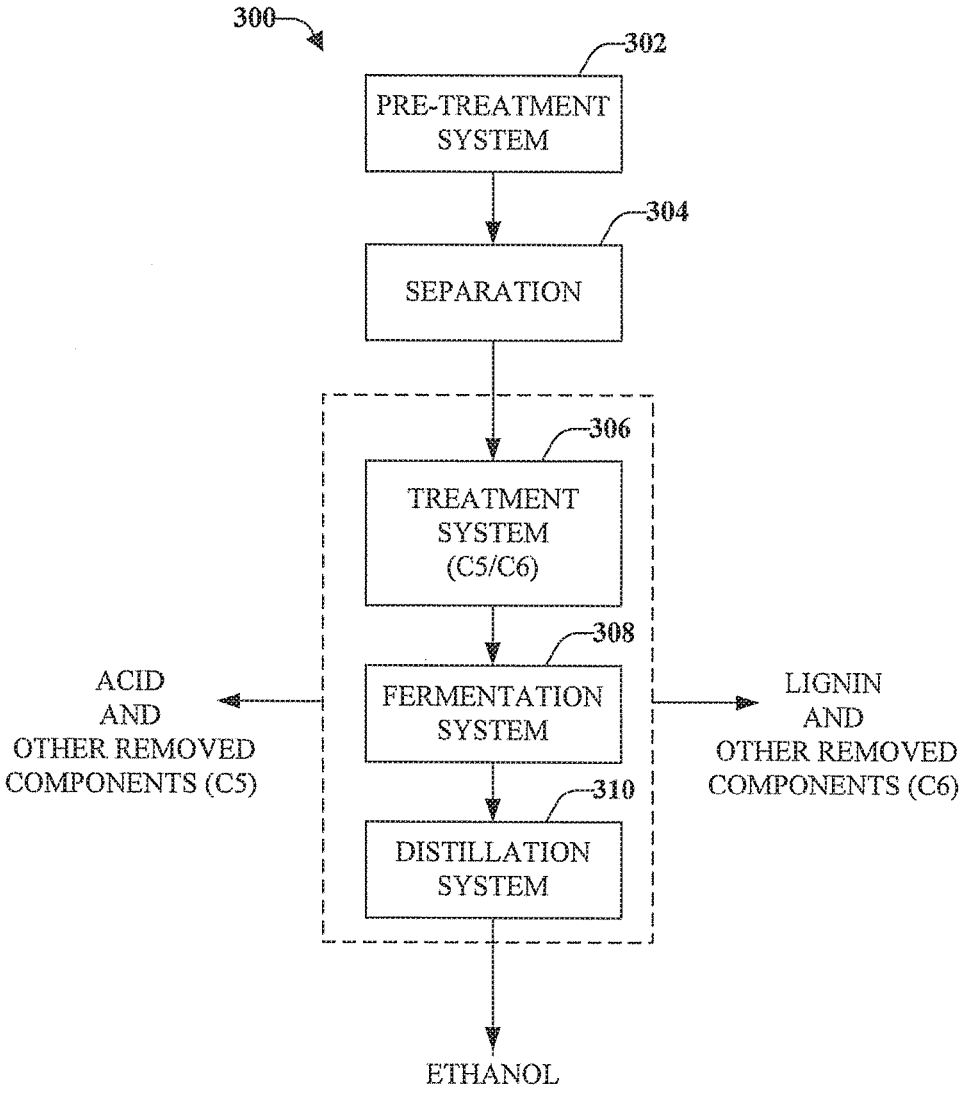
FIG. 3 is a schematic block diagram of a system for the production of ethanol from biomass.

Referring to FIG. 3, a schematic diagram of the cellulosic ethanol production facility 300 is shown. According to a preferred embodiment, biomass comprising plant material from the corn plant is prepared and cleaned at a preparation system. After preparation, the biomass is mixed with water into a slurry and is pre-treated at a pre-treatment system 302. In the pre-treatment system 302, the biomass is broken down (e.g. by hydrolysis) to facilitate separation 304 into a liquid component (e.g. a stream comprising the C5 sugars) and a solids component (e.g. a stream comprising cellulose from which the C6 sugars can be made available). The C5-sugar-containing liquid component (C5 stream) and C6-sugar-containing solids component (C6 stream) can be treated in a treatment system 306 (as may be suitable) and fermented in a fermentation system 308. Fermentation product from the fermentation system 308 is supplied to a distillation system 310 where the ethanol is recovered.

Figure 4C:
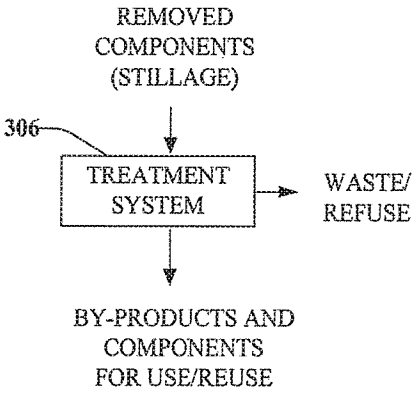
FIGS. 4A, 4B and 4C are schematic block diagrams of systems for treatment and processing of components from the production of ethanol from biomass.
Figure 4B:
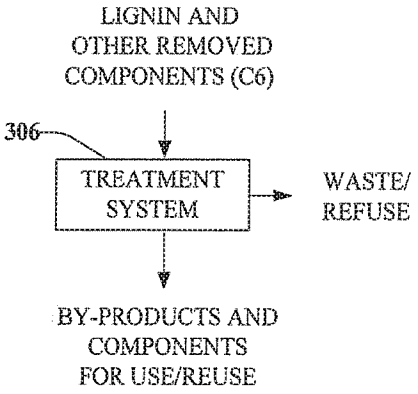
Figure 4A:
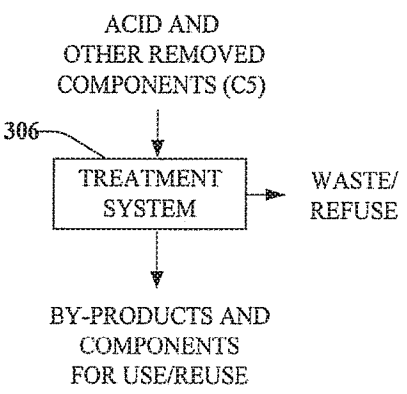

As shown in FIGS. 3 and 4A, removed components from treatment of the C5 stream can be treated or processed to recover by-products, such as organic acids and furfural. As shown in FIGS. 3 and 4B, removed components from treatment of the C6 stream, such as lignin or other components, can be treated or processed into bioproducts or into fuel (such as lignin for a solid fuel boiler or methane produced by treatment of residual/removed matter such as acids and lignin in an anaerobic digester). As shown in FIGS. 4A, 4B and 4C, components removed during treatment and production of ethanol from the biomass from either or both the C5 stream and the C6 stream (or at distillation) may be processed into bioproducts (e.g. by-products or co-products) or recovered for use or reuse. As shown in FIG. 4C, removed components from the distillation system (such as stillage or removed solids) or from the treatment of the fermentation product before distillation (e.g.

removed solids and particulate matter, which may comprise residual lignin, etc.) can be treated or processed into bio-products or fuel (e.g. methane produced in an anerobic digester). According to some aspects, removed components from the distillation system (as shown in FIG. 4C) can be used as a fuel for combustion to produce steam and/or energy.

Figure 5A:
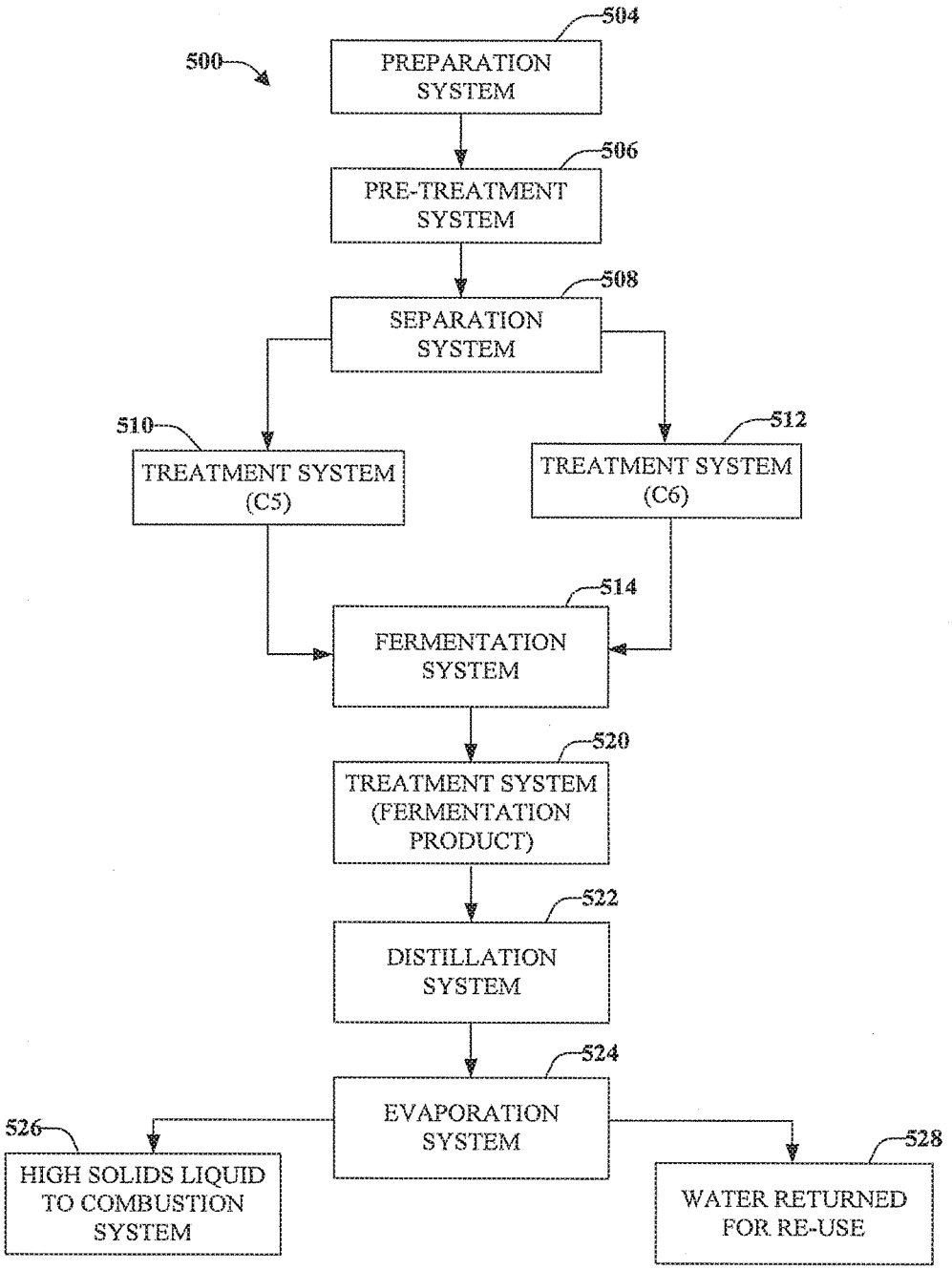
FIGS. 5A and 5B are schematic diagrams of the process flow for systems for the production of ethanol from biomass.
Figure 5B:
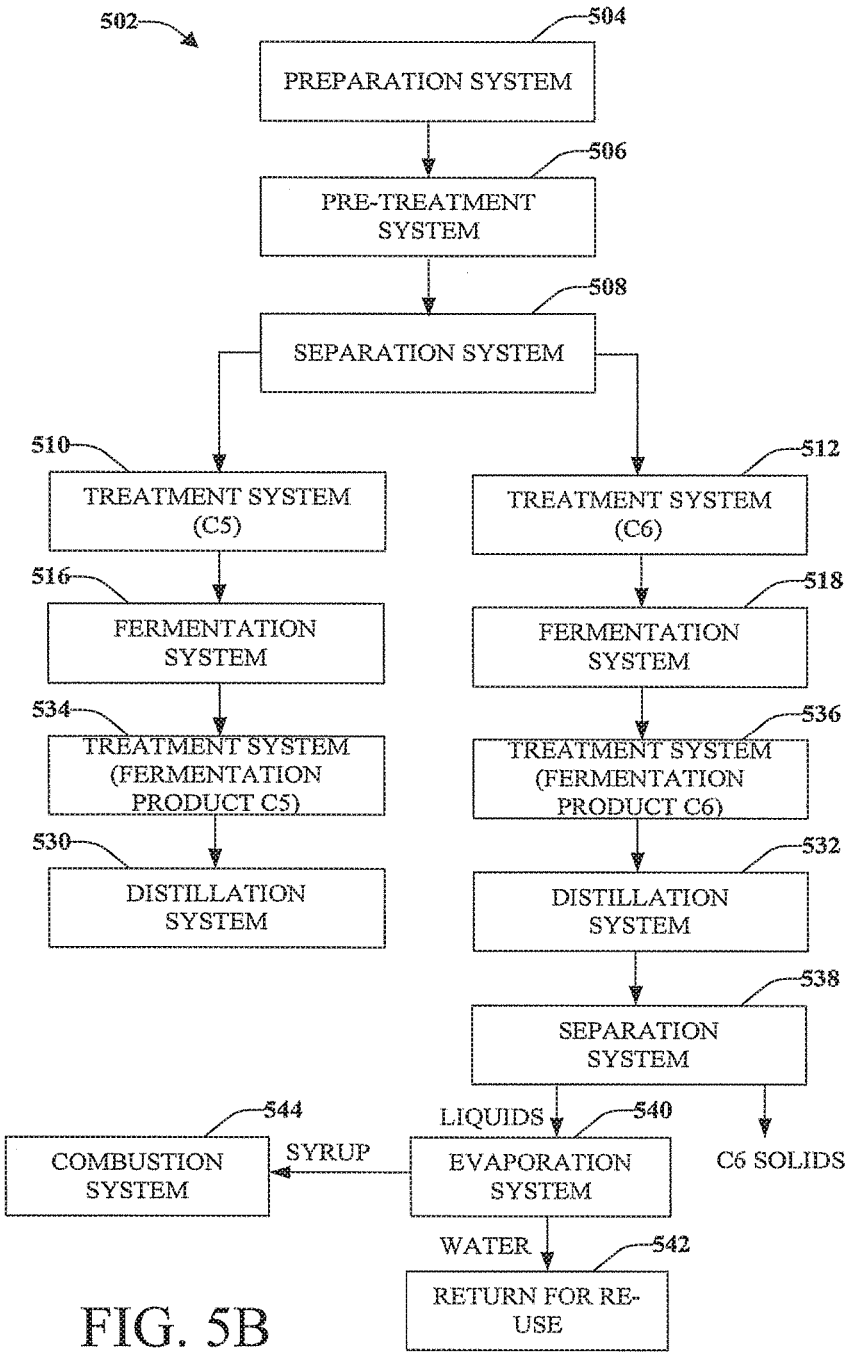

Referring to FIGS. 5A and 5B, exemplary embodiments of systems 500, 502 for the production of ethanol from biomass are shown. As shown in FIGS. 5A and 5B, biomass is prepared and cleaned at a preparation system 504 and is pre-treated in a pre-treatment system 506 and then separated (in a separation system 508) into a liquid component (C5 stream) and a solids component (C6 stream).

The liquid component (C5 stream) comprises water, dissolved sugars (such as xylose, arabinose and glucose) to be made available for fermentation into ethanol, acids and other soluble components recovered from the hemicellulose. The solids component (C6 stream) comprises water, acids and solids such as cellulose from which sugar, such as glucose, can be made available for fermentation into ethanol, and lignin.

After pre-treatment and separation, the C5 stream and the C6 stream are processed separately; as shown, the C5 stream and the C6 stream may be processed separately (in separate treatment systems 510, 512) prior to co-fermentation (C5/C6 fermentation system 514 as shown in FIG. 5A) or processed separately (in separate treatment systems 510, 512) including separate fermentation (separate C5 fermentation and C6 fermentation 516, 518 as shown in FIG. 5B).

According to an exemplary embodiment shown in FIG. 5A, after pre-treatment and separation the C5 stream and the C6 stream can be treated separately and subsequently combined after treatment (e.g. as a slurry) for co-fermentation in the fermentation system 514 to produce a C5/C6 fermentation product from the available sugars (e.g. xylose and glucose); the C5/C6 fermentation product can (after treatment 520, if any) be supplied to the distillation system 522 for recovery of the ethanol (e.g. through distillation and dehydration). The liquid component can be evaporated 524 to produce high solids liquid, suitable for combustion in a combustion system 526, according to an aspect. Water 528 from the evaporation 524 can be re-used. According to an aspect, evaporation of the whole stillage can increase a solids content, wherein the increased solids content can produce a high solids liquid suitable for combustion.

According to an exemplary embodiment shown in FIG. 5B, the C5 stream and the C6 stream can each be separately processed through fermentation 516, 518 and distillation 530, 532 (after treatment 534, 536, if any) to produce ethanol. After distillation 532 the C6 solids are separated in a separation system 538, producing C6 solids and liquids. The liquids are evaporated, in an evaporation system 540, wherein water is re-used 542 and syrup is sent to a combustion system 544 for combustion according to an aspect.

Figure 6:
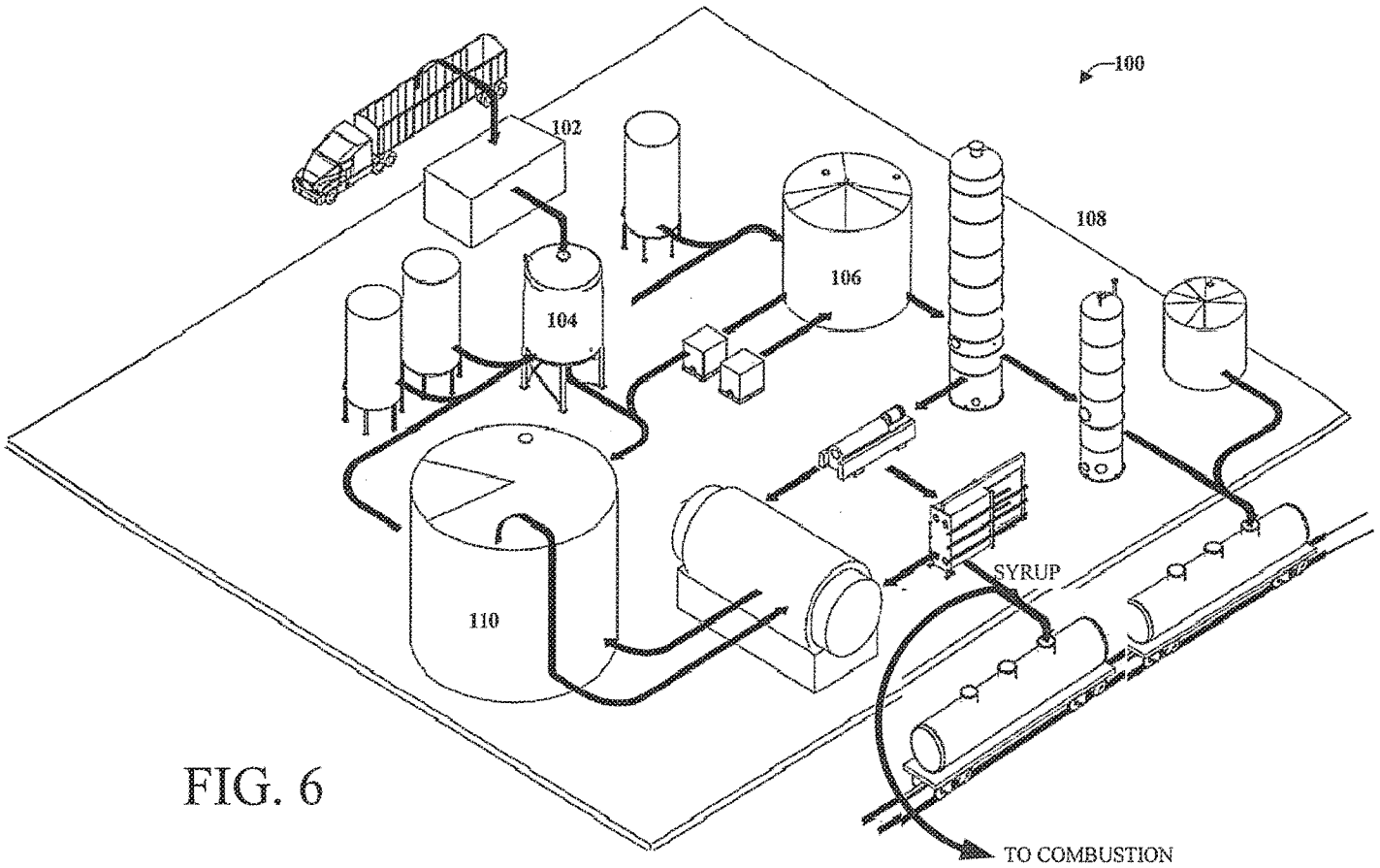
FIG. 6 is a perspective view of a biorefinery comprising a cellulosic ethanol production facility that combusts high solids liquid.

According to an aspect, syrup from an ethanol plant can be co-combusted in a stoker grate boiler to produce energy (e.g., steam energy, electrical energy) to power any suitable process, as shown in FIG. 6. A stoker grate boiler is one type of apparatus used to produce steam energy, such as the steam energy used by an ethanol plant. Stoker grate boilers combust solid fuels (e.g., biomass, including wood, cobs, corn stover, and so forth), but do not conventionally combust liquid fuels.

The high solids liquid can be a liquid with a high amount of combustible solids, wherein the combustible solids are small in size (e.g., in a powder form). The combustible solids can be syrup or whole stillage derived from an ethanol production process (cellulosic or starch based), as illustrated. However, the combustible solids can be derived from other processes, such as black liquor derived from a pulp mill, for example.

Figure 7:
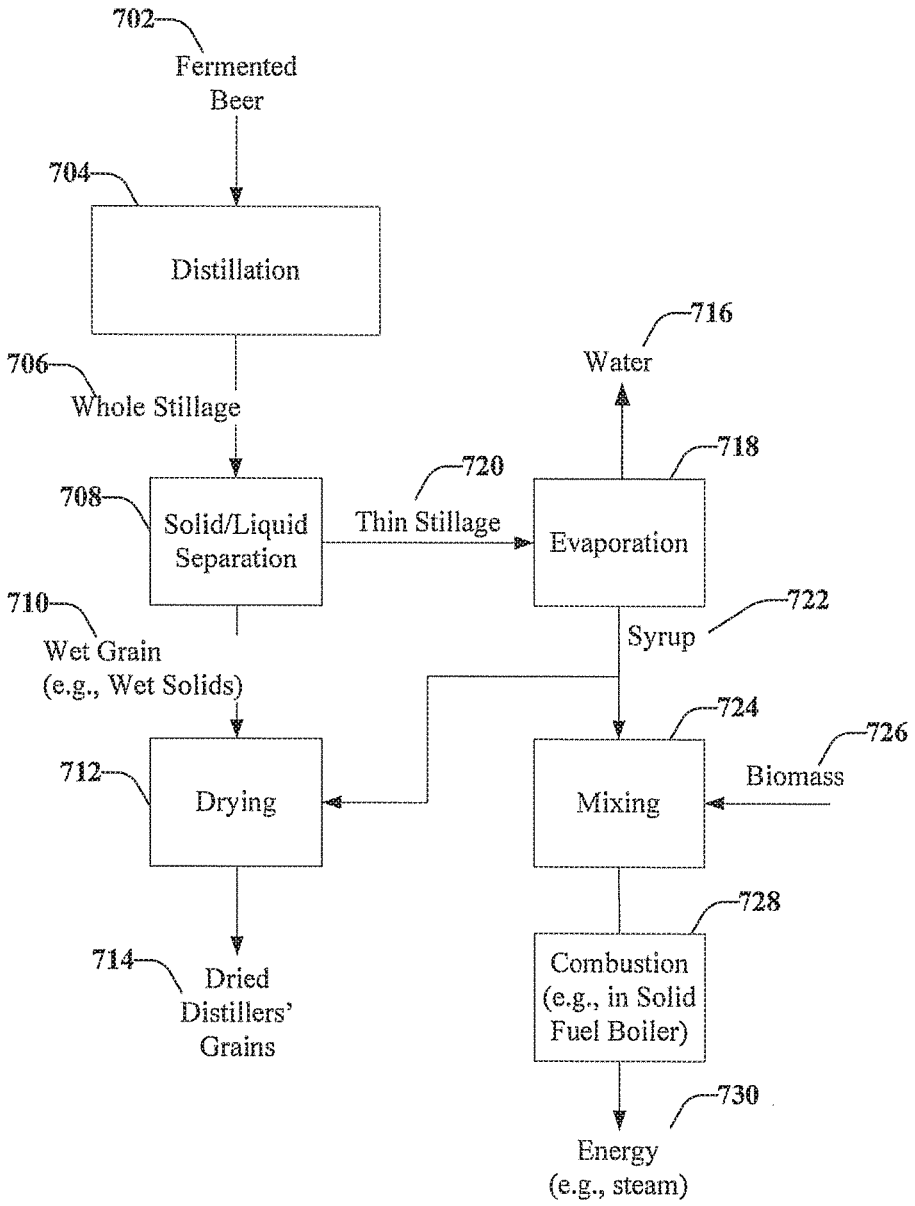
FIG. 7 is a schematic block diagram of a system for combusting high solids liquid, such as syrup mixed with wood.

As shown in FIG. 7, a method of producing commercial grain ethanol is to cook corn solids, converting starches in the corn solids to sugars and then to ferment the sugars. After fermentation, ethanol is separated from the fermented beer 702 during distillation 704. The distillation 704 vaporizes ethanol along with some water. The material discharged from the distillation 704 is distillate (primarily comprising water) and whole stillage 706, which comprises various solids, water, and dissolved components. Solids from the whole stillage are largely separated from water (solid/liquid separation 708), producing wet grain 710 (e.g., wet solids), which are dried 712. The dried solids are marketed as distillers' grains, commonly referred to as dried distillers' grains 714. Water 716 is evaporated 718 from thin stillage 720, creating syrup 722, which is a high solids liquid. The syrup can be blended with distiller's grains to produce a product marketed as dried distiller's grains with solubles. The water 716 can be re-used within the plant.

According to an aspect, at least a portion of the syrup 722 (or other high solids liquid) can be mixed 724 with biomass 726 and combusted 728, such as in a solid fuel boiler to create energy 730, which can be in the form of steam. Thus, wood fuel (or other biomass fuel) is used as the primary medium for delivering syrup to the furnace.

As produced in an ethanol plant, syrup and C6 solids comprise a high percentage of moisture, as shown in FIGS. 17 and 18. Combustion analysis was performed on syrup (see FIG. 17) and the energy of syrup with this moisture was observed to be approximately 3,648 Btu/lb. When dried to substantially no moisture, the syrup was observed to have an energy of approximately 9,176 Btu/lb. In comparison, wood fuel was observed to generally have an energy content of between 7,600 and 9,600 Btu/lb, when bone dry. Combustion analysis of the C6 solids was performed (see FIG. 18) and the energy of the C6 solids with this moisture was observed to be about 2,551 Btu/lb. When dried to substantially no moisture, the C6 solids was observed to have an energy of about 8,856 Btu/lb.

Figure 8:
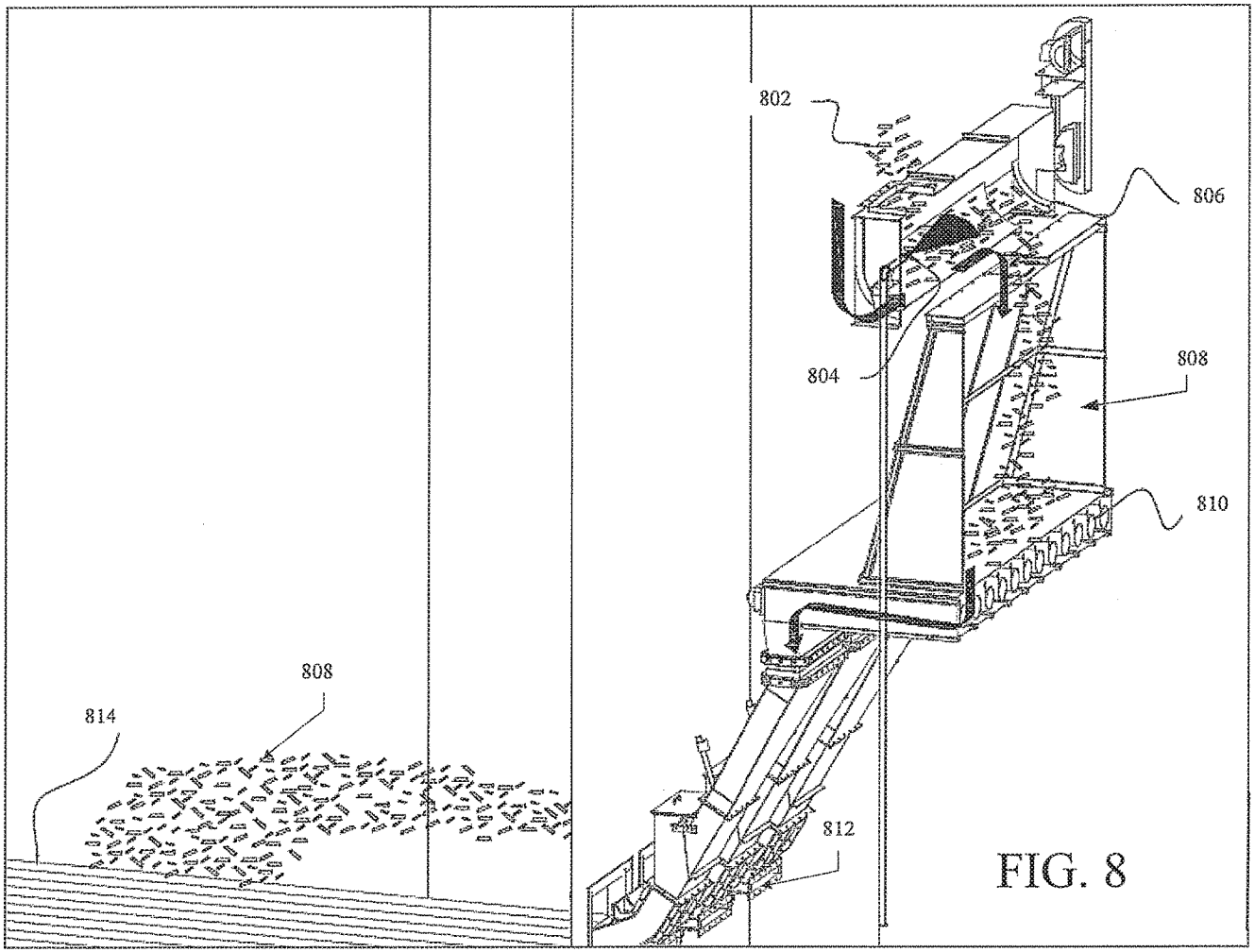
FIG. 8 is a schematic perspective view of a system for combusting high solids liquid, such as syrup mixed with wood.

FIG. 8 is a schematic perspective view of a system for combusting high solids liquid, such as syrup mixed with wood, according to some aspects. The high solids liquid can be created by the system of FIG. 7 and can be applied to a solid fuel (e.g., biomass) and mixed prior to combustion, according to an aspect. Biomass, such as the illustrated wood fuel 802, or another type of biomass fuel, is placed in contact with syrup 804 (or other high solids liquid), wherein the syrup 804 is from an ethanol plant. According to an aspect, the syrup 804 is sprayed on the wood fuel 802. A paddle mixer 806 (or other mechanism for mixing) agitates the wood fuel 802 and the syrup 804 to create a wood and syrup mixture 808. The agitation facilitates the syrup 804 coating the outer surface of the wood fuel 802.

The wood and syrup mixture 808 is loaded into a metering bin 810 and fed into a furnace by air swept fuel distributors 812 and onto stoker grates 814 of the stoker grate boiler. The wood and syrup mixture 808 is fed into the furnace using a conventional wood burning technique and combusted.

Figure 9:
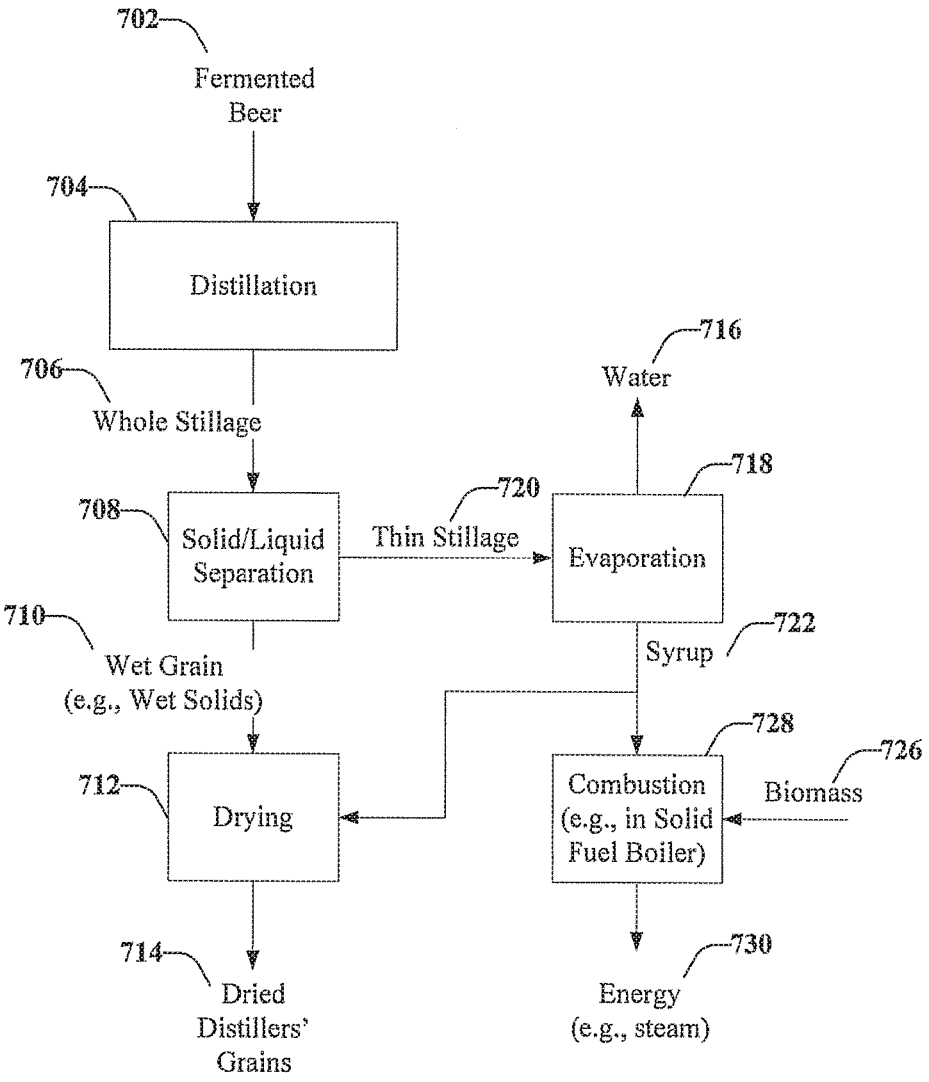
FIG. 9 is a schematic block diagram of a system for combusting high solids liquid, such as syrup.
Figure 10:
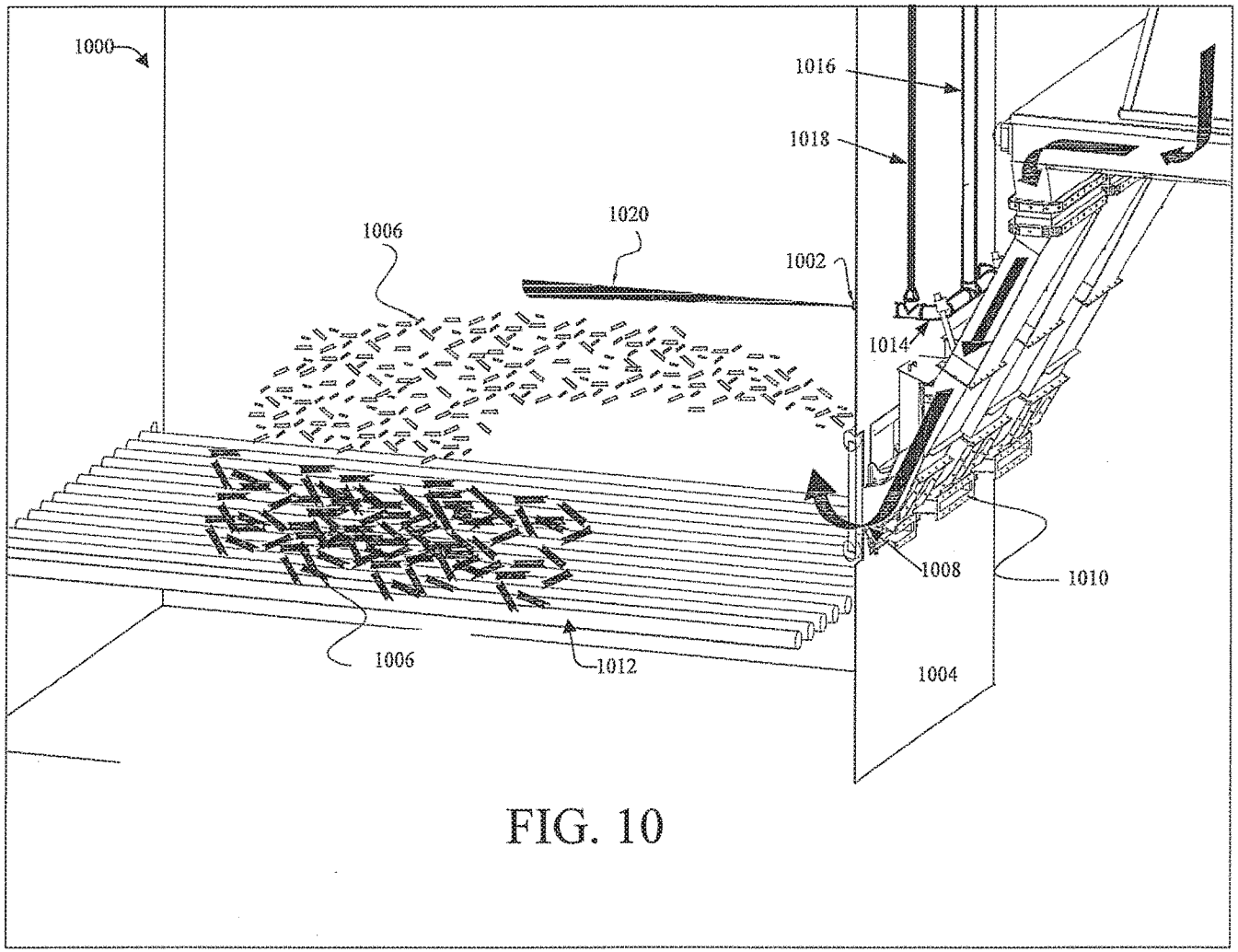
FIG. 10 is a schematic perspective view of a system for combusting high solids liquid, such as syrup.
Figure 11:
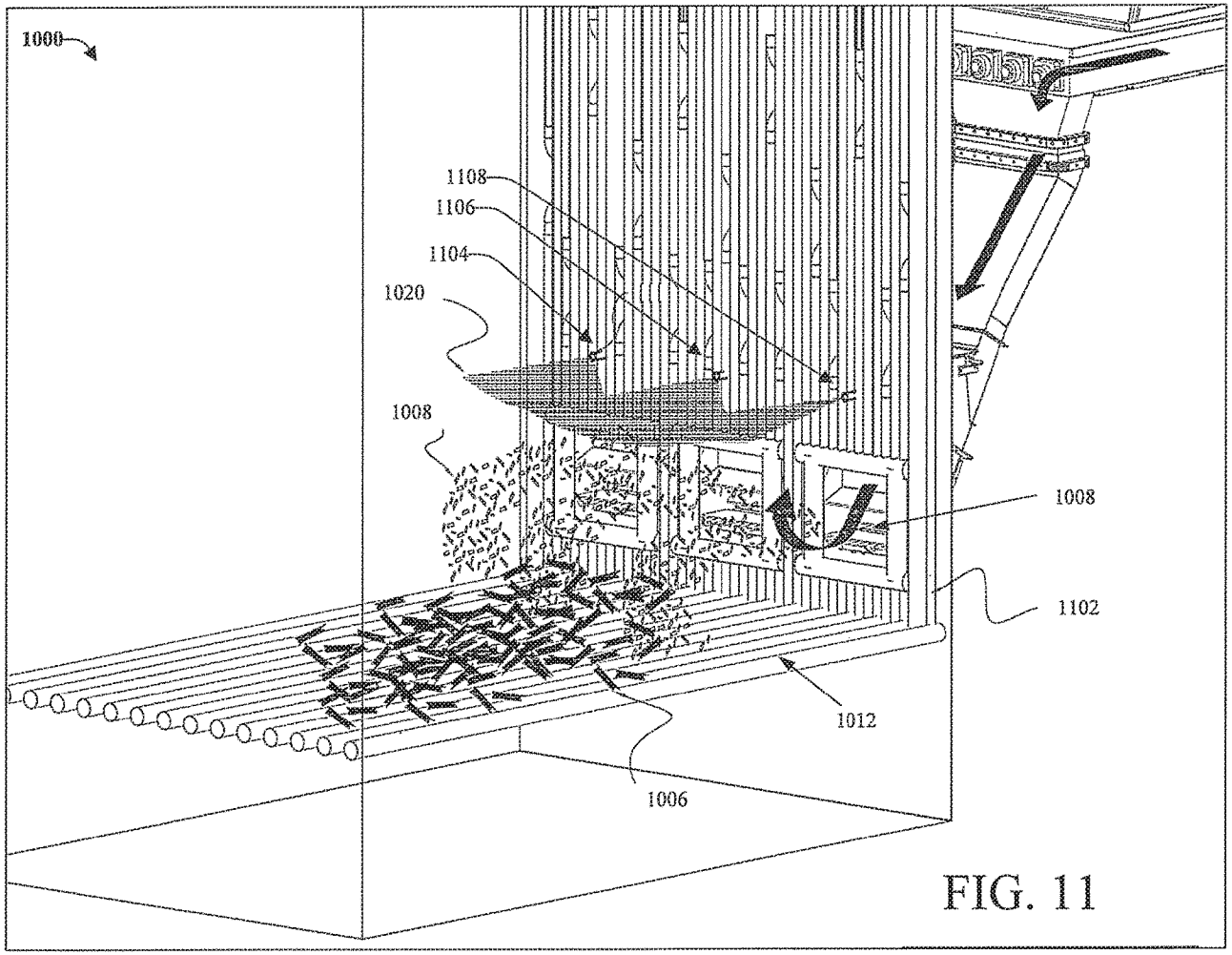
FIG. 11 is a schematic perspective view of a system for combusting high solids liquid, illustrating a horizontal configuration of spray nozzles, according to an aspect.
Figure 12:
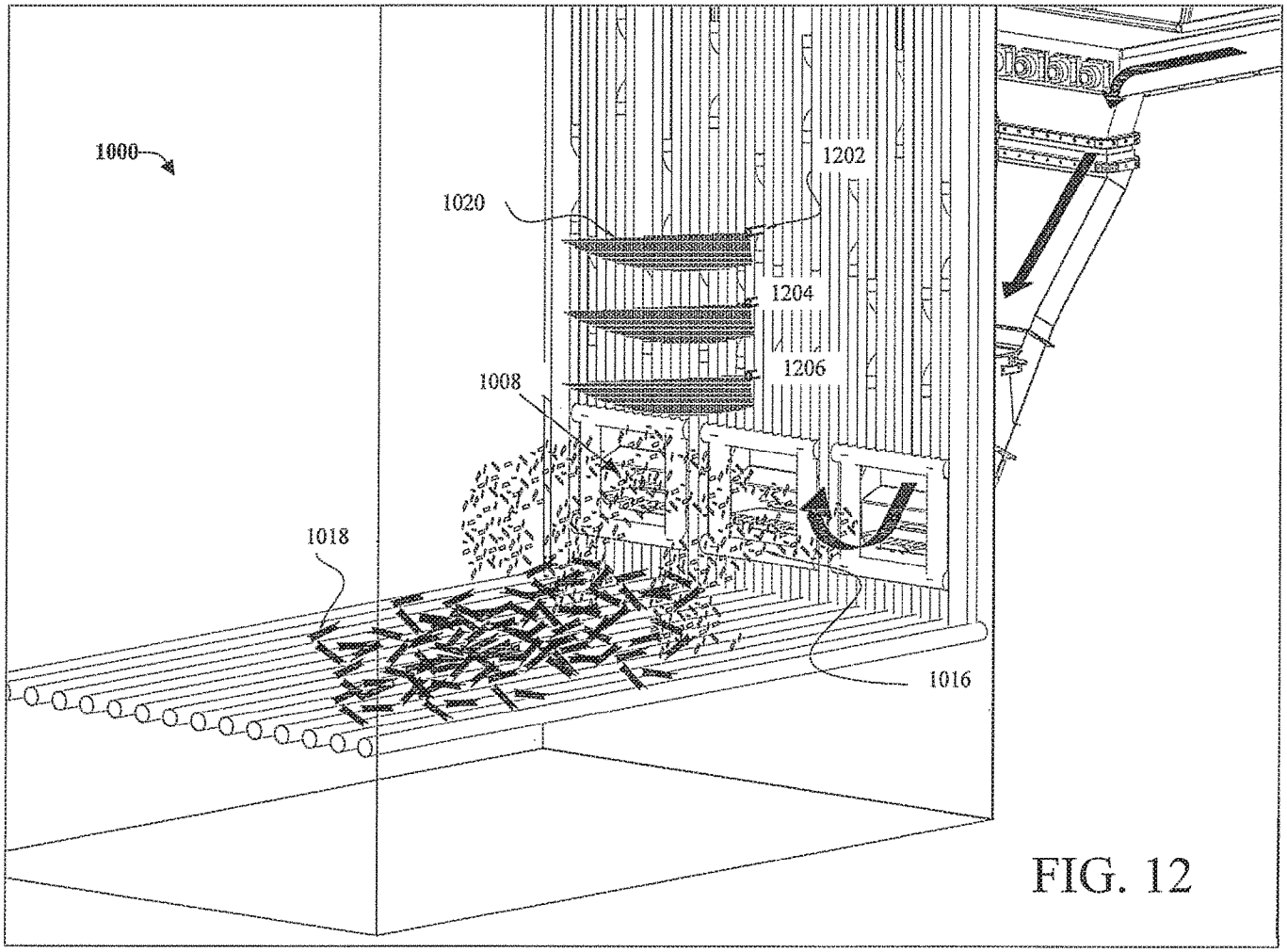
FIG. 12 is a schematic perspective view of a system for combusting high solids liquid, illustrating a vertical configuration of spray nozzles, according to an aspect.

In accordance with some aspects, as shown in FIG. 9, at least a portion of the syrup 722 and the biomass 726 can be combusted 728 without the mixing 724, shown in FIG. 7. As shown in FIGS. 10, 11, and 12, the syrup can be combusted by employing one or more nozzles that spray (e.g., atomize)

syrup (or other high solids liquid) into the furnace 1000 using an atomizing fluid, such as compressed air or high pressure steam. In these aspects, wood is not used as the primary medium for delivering syrup to the furnace.

At least one nozzle 1002 is positioned in the lower portion of the membrane wall 1004 of the furnace 1000. Solid fuel combusted on the stoker grate is used to ignite syrup that is atomized through the at least one nozzle 1002 into the furnace, above the stoker grate. Wood fuel 1006 is directed into the furnace through openings 1008 by air swept fuel distributors 1010 to maintain combustion of wood fuel 1006 on the stoker grate 1012. Syrup is delivered to a manifold 1014 by a syrup supply line 1016. By atomizing syrup directly into the furnace at a selectable rate, the rate at which syrup is combusted can be selected to produce the best results possible. Since the syrup is atomized into the furnace, wood is not needed to carry the syrup into the furnace and the syrup combustion rate is not as dependent on the wood combustion rate. Further, wood in the metering bin is not placed in contact with syrup prior to the wood being delivered into the furnace, thus, the system for metering wood into the furnace does not come in contact with syrup, which mitigates plugging of the metering bin outlets, feed chutes, and air swept distributors and can provide an increased syrup combustion rate range.

According to an aspect, the nozzles can each comprise a flat fan nozzle, commercially available, for example, Model NF from BETE Fog Nozzle, Inc. of Greenfield, Mass., attached to a stainless steel nipple that protrudes into the furnace. The nozzle can be connected to a manifold that allowed compressed air and syrup to be combined prior to entering the nozzle. The compressed air 1018 assists atomization of the syrup, which allows the atomized syrup 1020 to combust (in suspension) above the combusting wood fuel on the stoker grate.

Figure 13A:
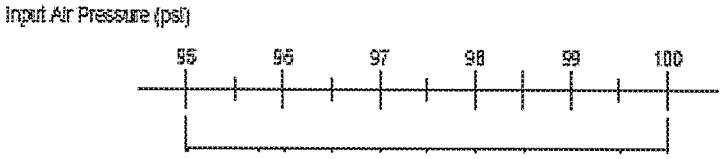
FIGS. 13A, 13B, and 13C show sample operating parameters for combusting syrup, according to an aspect.
Figure 13B:
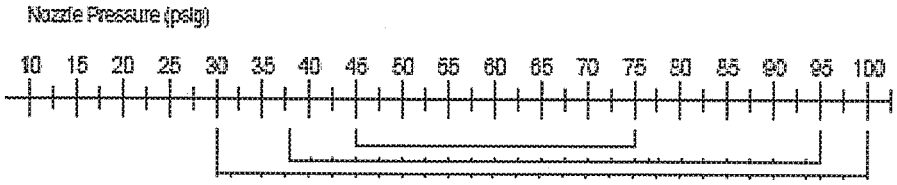
Figure 13C:
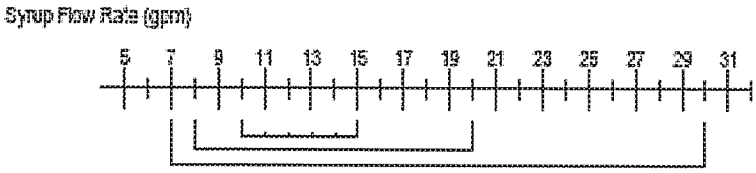

Sample operating conditions for a combustion system that combusts high solids liquid are shown in FIGS. 13A through 13C. Operating conditions for each subject condition can be indicated as "nested" ranges, comprising an acceptable operating range (the outer/wide range shown), a preferred operating range (the middle range shown, if applicable), and a particularly preferred operating range (the inner/narrow range shown, if applicable). As shown in FIG. 13A, a typical input air pressure (e.g. compressed air supplied to the nozzles) can be from about 95 to 100 PSI. As shown in FIG. 13B, a typical nozzle pressure is around 30 to 100 psig (pound-force per square inch gauge); a preferred nozzle pressure is approximately 38 to 95 psig; a particularly preferred nozzle pressure is about 45 to 75 psig. As shown in FIG. 13C, a typical syrup flow rate is approximately 7 to 30 gallons per minute (gpm); a preferred syrup flow rate is about 8 to 20 gpm; and a particularly preferred syrup flow rate is around 10 to 15 gpm. It should be noted that the operating conditions can be different depending on the size of the furnace, the type and size of nozzles utilized with the combustion system, and so forth.

According to some aspects, the liquid fuel (e.g., syrup, whole stillage, or evaporated whole stillage) is atomized 1020 into the furnace 1000 through a space between the membrane wall tubes on the front 1102 of the furnace (as shown in FIG. 11). Atomizing can include using pressure drop or an atomizing medium (e.g., compressed air). The nozzle 1002 and its mounting assembly can be configured so as to not attach to parts classified by ASME (American Society of Mechanical Engineers) as "pressure parts" of the stoker grate boiler. The mounting assembly can be welded to the membrane, according to an aspect. The placement of the at least one nozzle 1002 can allow the nozzle 1002 to be fully serviced from the exterior of the boiler. The manifold 1014 is utilized to inject (e.g., mix) compressed air or high pressure steam with the syrup before the mixture exits nozzle 1002. The flow of compressed air can remain enabled when no syrup is flowing into the nozzle to provide cooling of the nozzle and to clean the nozzle of any remaining syrup.

As shown in FIG. 11, according to an embodiment, a set of nozzles 1104, 1106, and 1108 (illustrated as a set of three nozzles although any number of nozzles can be utilized) can be positioned in a horizontal configuration. The spray pattern of each nozzle can be a fan type pattern, which can widely distribute the atomized syrup over the combusting biomass fuel on the stoker grate. According to some aspects, the spray nozzle(s) can spray in a straight pattern at about a 120 degree angle. According to some aspects, the spray angle is around 100 degree angle. However, the disclosed aspects can be utilized with spray angles having different spray patterns, which can be selected as a function of the furnace.

According to some aspects, the spray pattern of the outside nozzles 1104, 1108 can be narrower than the spray pattern of the inside nozzle(s) 1106 to mitigate the chance that the outside nozzles 1104, 1108 will spray syrup onto the wall of the furnace 1000, where it might not combust completely. According to an embodiment, shown in FIG. 12, a set of nozzles 1202, 1204, 1206 (shown as a set of three nozzles although any number of nozzles can be utilized) may be positioned in a vertical configuration. The spray pattern of each nozzle can be a fan type pattern, which can widely distribute the atomized syrup over the combusting biomass fuel on the stoker grate. According to some aspects, each nozzle can be offset (toward the center of the furnace) in the horizontal plane.

In accordance with some aspects, heat can be utilized to atomize the syrup, wherein the syrup is heated at a pressure above atmospheric pressure. In order for the syrup to vaporize as it decreases in pressure by exiting the one or more nozzles, the temperature of the syrup could be below its high pressure vaporization temperature, but above approximately 212 degrees Fahrenheit. Under these conditions, heated syrup will atomize as it exists the nozzle and combust above the stoker grate.

The syrup injection nozzle can be applied to various applications involving liquids having high solids content in a stoker grate boiler having a secondary flame source (e.g., biomass co-fired boiler).

A series of examples were conducted according to an exemplary embodiment of the system (as shown in FIGS. 5A, 5B, and 9) in an effort to determine suitable apparatus and operating conditions for the combustion of syrup. Data from the examples is shown in FIGS. 14 through 16 and FIGS. 19 through 21.

Example 1

The combustion system was used in Example 1 to test the effect on CO (Carbon Monoxide) and NOx (Nitrogen Oxides) emissions. Observations indicated that the combustion of syrup caused minimal increases in CO and NOx emissions compared to operation without combustion of syrup. However, the operation of the combustion system using water was observed to cause higher CO emission levels. It was observed that operating between 10 and 15 gpm yields the lowest combined CO and NOx emissions.

Figure 14:
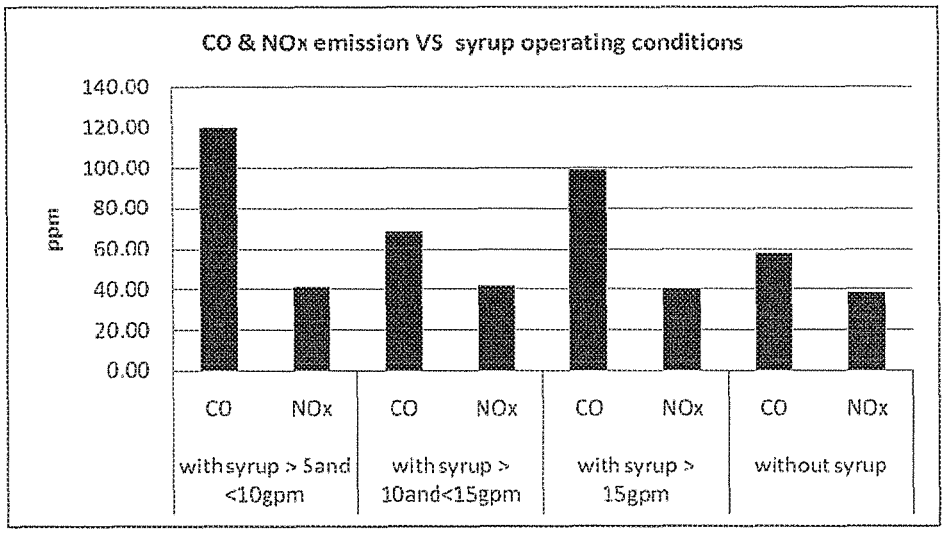
FIGS. 14, 15, and 16 are graphs of the results of combustion of high solids liquid according to an exemplary embodiment.

The CO emissions were the lowest between 10 and 15 gpm of syrup combustion. The results are shown in FIG. 14 and FIG. 19.

Example 2

Figure 15:
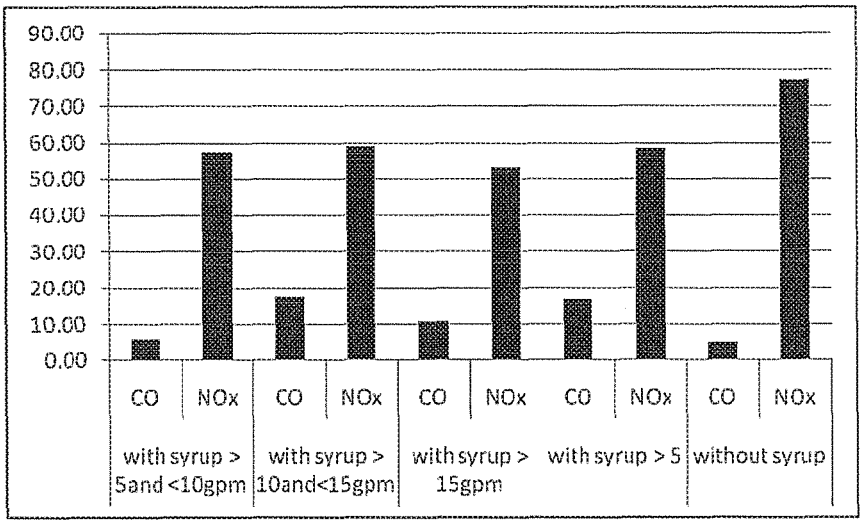

The combustion system was used in Example 2 to test the effect on CO (Carbon Monoxide) and NOx (Nitrogen Oxides) emissions when a urea system, which is a SNCR (Selective non-catalytic reduction (SNCR) for NOx control) system that controls NOx emissions by injecting urea into the furnace, was not operational. Thus, Example 2 provides NOx emission data without the NOx being affected by urea injection, as indicated in FIG. 15. Observations indicated that syrup reduces NOx emissions approximately 20 ppm. The higher the syrup flow the better the NOx control. It was also observed that syrup did not help with the CO control. The CO emissions increased but remained below acceptable emissions limits. The results are shown in FIG. 15 and FIG. 21.

Example 3

Figure 16:
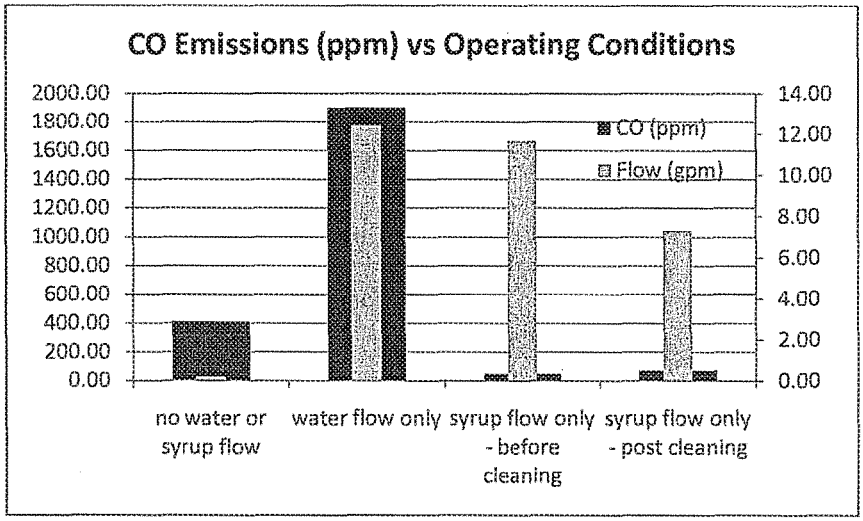

The combustion system was used in Example 3 to test whether syrup (or a high solids liquid) decreased the observed CO emissions compared to both water injection and no injection. It was observed that the CO emission level was lower for both syrup flow rates than with no syrup and that water greatly increased the CO emissions. The test was conducted during a shutdown of the syrup combustion system. Prior to the shutdown, the CO averaged 49.47 ppm with a syrup flow rate of 11.69 gpm. During shutdown, water was flushed through the combustion system to clean rinse the system. Once the water entered the furnace, the CO emissions increased to an average of 1900.14 ppm at a water flow rate of 12.41 gpm. During the shutdown, when no water or syrup was flowing, the CO emissions averaged 412.29 ppm. After the combustion system was placed back into service, CO emissions averaged 73.59 ppm with a syrup flow rate of 7.34 gpm. The test indicated that syrup combustion reduces CO emissions. The results are shown in FIG. 16 and FIG. 21.

The embodiments as disclosed and described in the application (including the FIGS. and Examples) are intended to be illustrative and explanatory of the present invention. Modifications and variations of the disclosed embodiments, for example, of the apparatus and processes employed (or to be employed) as well as of the compositions and treatments used (or to be used), are possible; all such modifications and variations are intended to be within the scope of the present invention.

The word "exemplary" is used to mean serving as an example, instance, or illustration. Any embodiment or design described as "exemplary" is not necessarily to be construed as preferred or advantageous over other embodiments or designs, nor is it meant to preclude equivalent exemplary structures and techniques known to those of ordinary skill in the art. Rather, use of the word exemplary is intended to present concepts in a concrete fashion, and the disclosed subject matter is not limited by such examples.

The term "or" is intended to mean an inclusive "or" rather than an exclusive "or." To the extent that the terms "comprises," "has," "contains," and other similar words are used in either the detailed description or the claims, for the avoidance of doubt, such terms are intended to be inclusive in a manner similar to the term "comprising" as an open transition word without precluding any additional or other elements.

What is claimed is:

1. A method for combusting a high solids liquid, comprising:

supplying a stream of high solids liquid to a stoker grate boiler, wherein the stream of high solids liquid is atomized to form an atomized stream of high solids liquid; and distributing biomass into the stoker grate boiler;

wherein the atomized stream of high solids liquid is combusted in suspension above the biomass in the stoker grate boiler.

2. The method of claim 1, wherein the atomizing comprises employing one or more nozzles.

3. The method of claim 2, wherein the atomizing further comprises using an atomization fluid.

4. The method of claim 3, wherein the atomization fluid comprises compressed air.

5. The method of claim 4, wherein the one or more nozzles are positioned in a horizontal configuration.

6. The method of claim 5, wherein the one or more nozzles create a spray pattern and the spray pattern is a fan type pattern.

7. The method of claim 6, wherein the one or more nozzles comprise at least one flat fan nozzle.

8. The method of claim 7, wherein the nozzle pressure is within the range of 30 to 100 pound-force per square inch gauge, inclusive.

9. The method of claim 8, further comprising selectively altering the rate at which the atomized high solids liquid is supplied.

10. The method of claim 4, wherein the one or more nozzles are positioned in a vertical configuration.

11. The method of claim 10, wherein the one or more nozzles create a spray pattern and the spray pattern is a fan type pattern.

12. The method of claim 11, wherein the one or more nozzles comprise at least one flat fan nozzle.

13. The method of claim 12, wherein the nozzle pressure is within the range of 30 to 100 pound-force per square inch gauge, inclusive.

14. The method of claim 13, further comprising selectively altering the rate at which the atomized high solids liquid is supplied.

15. The method of claim 3, wherein the atomization fluid comprises steam.

16. The method of claim 15, wherein the one or more nozzles are positioned in a horizontal configuration.

17. The method of claim 16, wherein the one or more nozzles create a spray pattern and the spray pattern is a fan type pattern.

18. The method of claim 17, wherein the one or more nozzles comprise at least one flat fan nozzle.

19. The method of claim 18, further comprising selectively altering the rate at which the atomized stream high solids liquid is supplied.

20. The method of claim 15, wherein the one or more nozzles are positioned in a vertical configuration.

21. The method of claim 20, wherein the one or more nozzles create a spray pattern and the spray pattern is a fan type pattern.

22. The method of claim 21, wherein the one or more nozzles comprise at least one flat fan nozzle.

23. The method of claim 22, further comprising selectively altering the rate at which the atomized stream of high solids liquid is supplied.

24. The method of claim 1, wherein the high solids liquid comprises syrup produced at an ethanol plant that produces ethanol from corn starch.

25. The method of claim 1, wherein the high solids liquid comprises syrup produced at a biorefinery that converts lignocellulosic biomass into ethanol.

26. The method of claim 1, wherein the biomass is selected from at least one member of the group consisting of corn cobs, corn stover, fiber from corn kernels, switchgrass, farm residue, agricultural residue, wood chips and other wood waste.

* * * * *